United States Patent [19]

Tada

[11] Patent Number: 4,589,573

[45] Date of Patent: May 20, 1986

[54] HEAD DEPRESSION TYPE DISPENSER

[75] Inventor: Tetsuya Tada, Tokyo, Japan

[73] Assignee: Canyon Corporation, Tokyo, Japan

[21] Appl. No.: 417,876

[22] Filed: Sep. 14, 1982

[30] Foreign Application Priority Data

Jun. 29, 1982 [JP] Japan ..... 57-112032

[51] Int. Cl.[4] ..... B65D 47/34

[52] U.S. Cl. ..... 222/153; 222/214; 222/321; 222/384

[58] Field of Search ..... 222/153, 206, 207, 209, 222/211, 215, 214, 321, 340, 341, 372, 380, 382, 383, 384, 385, 402.11

[56] References Cited

U.S. PATENT DOCUMENTS

| | | | |
|---|---|---|---|
| 2,662,485 | 12/1953 | Ilfrey | 137/853 X |
| 3,325,054 | 6/1967 | Braun | 222/153 X |
| 3,422,996 | 1/1969 | Lipman | 222/402.11 |
| 3,452,905 | 7/1969 | Micallef | 222/321 X |
| 3,749,290 | 7/1973 | Micallef | 222/385 |
| 4,088,248 | 5/1978 | Blake | 222/207 |
| 4,420,096 | 12/1983 | Kirk, Jr. | 222/321 X |

FOREIGN PATENT DOCUMENTS 15521 1/1978 Australia .

*Primary Examiner*—Joseph J. Rolla
*Assistant Examiner*—Frederick R. Handren
*Attorney, Agent, or Firm*—Frishauf, Holtz, Goodman & Woodward

[57] ABSTRACT

A head depression type dispenser comprises a cylinder formed of an elastic material such as rubber. The cylinder is arranged between a head and a cap, and is constructed to operate as a piston for sucking and pressurizing liquid by axial deformation of the cylinder upon movement of the head. When the depressing force applied to its head is removed after the cylinder is deformed, the cylinder will return to the original shape by its own elasticity. In addition, a sealing piece extends from the cylinder into the passage of the head, thereby closely contacting the inner wall of the passage to form a secondary valve. The sealing piece becomes isolated from the inner wall of the passage when the hydraulic pressure in the cylinder exceeds the elasticity of the sealing piece, allowing the flow of the compressed liquid through the passage, and closely contacts the inner wall of the passage by the elasticity of the sealing piece when the hydraulic pressure becomes lower than the elasticity of the sealing piece. Since the cylinder can deform in its axial direction, it can be sufficiently deformed, thereby sufficiently pressurizing the liquid to a high pressure.

1 Claim, 7 Drawing Figures

HEAD DEPRESSION TYPE DISPENSER

BACKGROUND OF THE INVENTION

The present invention relates to a head depression type dispenser which is capable of being mounted on a container via a cap for drawing liquid in the container into a cylinder and pressurizing and dispensing the liquid by the movement of a piston in the cylinder, the piston movement being produced by the depression of a head thereof.

In a conventional dispenser of this type, a piston is mounted in a head, a cylinder is mounted in a cap, and the dispenser is mounted on a container via the cap. This dispenser is constructed to lower the piston together with the head by depressing the head, for example, in a downward direction, thereby dispensing liquid contained in the container. In other words, when the head is depressed, the piston descends in the cylinder, thereby dispensing the liquid in the container. A conventional head depression type dispenser generally includes a head, a cap, a piston mounted in the head, a cylinder mounted in the cap, primary and secondary valves for controlling the inflow and outflow of liquid in the cylinder, a return spring for biasing the piston, and a secondary valve spring for pressing the secondary valve to a valve seat. Thus, the conventional head depression type dispenser includes at least eight components. If the number of components can be reduced, it will not only decrease the manufacturing cost of the respective components but will simplify the assembling of the dispenser, thereby making the production of the dispenser inexpensive. For that purpose, various modifications have been applied to the conventional dispenser so as to reduce the number of its components. However, a head depression type dispenser which largely reduces the number of components has not yet been proposed.

On the other hand, there is disclosed in U.S. Pat. No. 3,749,290 issued on July 31, 1973 to L. A. Micallef, not a head depression type but a trigger type sprayer in which a cylinder is formed of any one of many available moldable flexible materials of either synthetic or natural resin or plastic. In this conventional sprayer, the upper end of a cylinder is engaged by the elasticity thereof with the outer surface of a lip formed on a sprayer body, thereby securing a liquid seal between the cylinder and the sprayer body to form a secondary valve. Accordingly, this sprayer does not have a secondary valve as an independent member. Futher, the elasticity of the cylinder itself serves as a secondary valve spring, thereby eliminating the secondary valve spring. The side of the cylinder is elastically pushed inward by an operating arm formed integrally with a trigger so as to pressurize the liquid in the cylinder. Further, negative pressure is produced in the cylinder by isolating the operating arm from the side of the cylinder to return the cylinder to the original shape, thereby sucking the liquid into the cylinder. Since the liquid is pressurized and sucked by the partial deformation of the cylinder, a piston is unnecessary, and a return spring for the piston is also unnecessary. Thus, in Micallef's sprayer, the piston, secondary valve, return spring for the piston and valve spring for secondary valve can be omitted. Since this sprayer, however, urges the operating arm to the side of the cylinder, the cylinder is elastically pushed only partly at the side, with the result that the liquid in the cylinder cannot be sufficiently pressurized. Further, since partial deformation occurs, the cylinder is accordingly damaged.

A head depression type dispenser in which the cylinder is formed of flexible material has not yet been proposed. Paricularly, the dispenser of this type should be necessarily packaged and conveyed in such a way as to prevent the depression of its head before initiating use of the dispenser. It is further necessary in the dispenser of this type to prevent the out-flow of liquid by the depression of its head due to careless movement or overturning when it is displayed in a shop. In other words, a so-called virgin lock is required to prevent the unnecessary or careless depression of its head before intentional use of the dispenser. It is also necessary to provide a locking means for protecting the dispenser against the depression of its head at a non-use time, even after the starting of use of the dispenser, so as to protect a child against an accident, making it "childproof". It has been desired to reduce the number of components of the conventional head depression type dispenser due to the necessity of such a virgin lock and childproofing, but on the contrary, there has been a trend toward increasing the number of components, thereby causing an increase in the production cost of the head depression type dispenser.

SUMMARY OF THE INVENTION

It is an object of the present invention to provide a head depression type dispenser which is capable of pressurizing liquid in a cylinder to sufficiently high pressure and of considerably reducing the number of components to be inexpensively manufactured.

In order to achieve the above and other objects, there is provided according to the present invention a head depression type dispenser in which a cylinder is formed of an elastic material such as rubber. The cylinder is arranged between a head and a cap, and is constructed to operate as a piston for sucking and pressurizing liquid by axial deformation of the cylinder upon movement of the head. Thus, this dispenser can eliminate an independent piston. Further, when the depressing force to its head is removed after the cylinder is deformed, the clyinder will return to the original shape by its own elasticity, thereby eliminating a return spring. In addition, a sealing piece extends from the cylinder into the passage of the head, thereby closely contacting the inner wall of the passage to form a secondary valve. Thus, this dispenser can also eliminate an independent secondary valve. The sealing piece deforms so as to be isolated from the inner wall of the passage when the hydraulic pressure in the cylinder exceeds the elasticity of the sealing piece, allowing the flow of the compressed liquid through the passage, and returns to its original shape to closely contact the inner wall of the passage by the elasticity of the sealing piece when the hydraulic pressure is lowered to become lower than the elasticity of the sealing piece. Thus, this dispenser can also eliminate the secondary valve spring. In this manner, according to the present invention, this dispenser can eliminate the necessity of the piston, secondary valve, return spring and secondary valve spring. Thus, the dispenser according to the present invention can reduce the number of its components to a mere four components. Moreover, since the cylinder can deform in its axial direction, it can be sufficiently deformed, thereby sufficiently pressurizing the liquid. Since the cylinder is, moreover, uniformly deformed, it can hardly be damaged as compared with the conventional dispenser of this type in which the side is partly deformed.

DETAILED DESCRIPTION OF THE PREFERRED EMBODIMENTS

Figure 1:
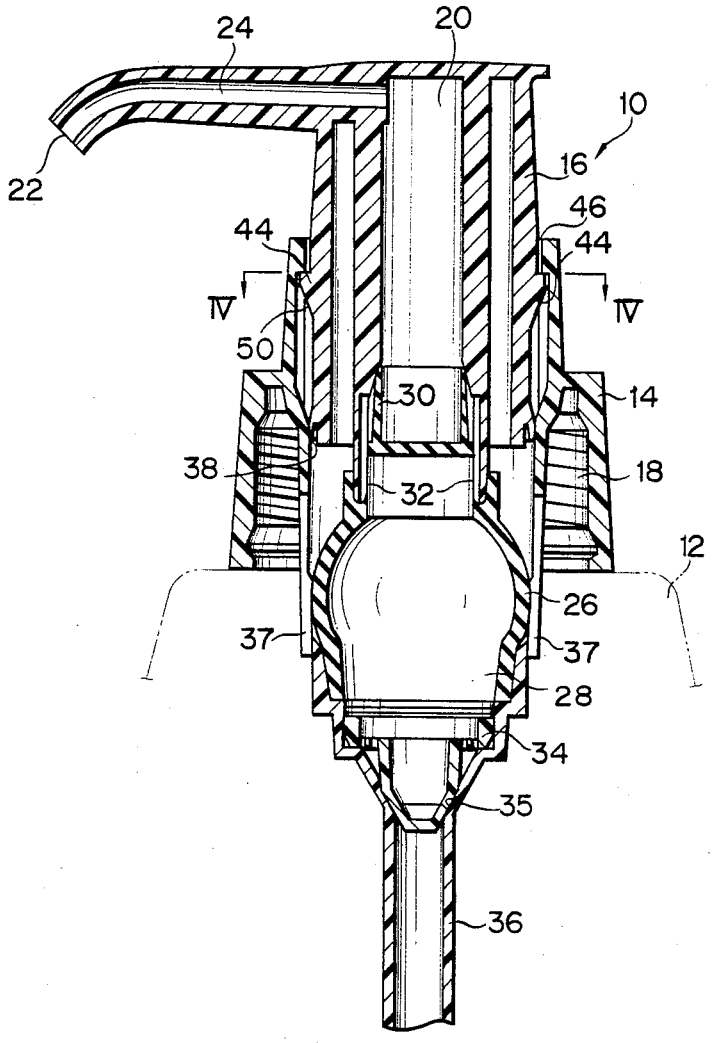
FIG. 1 is a longitudinal sectional view of a dispenser according to the present invention.

Referring to FIG. 1, a dispenser 10 according to the present invention comprises a container 12 for containing liquid to be dispensed, a cap 14 engageable with the container 12 and a head 16 rotatably and longitudinally movably, mounted in the cap 14. Female threads 18 are cut in the cap 14. In the head 16 are formed a vertical passage 20 and a horizontal passage 24 which communicates at its one end with the vertical passage 20 and forms at its other end an outlet port 22.

Figure 2:
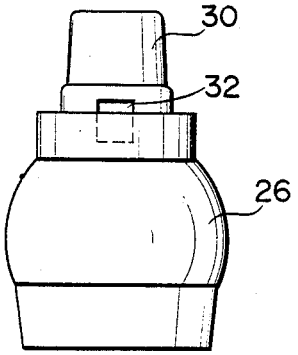
FIG. 2 is a front view of a cylinder used in the dispenser in FIG. 1.

As seen from FIG. 1, a cylinder 26 formed of an elastic material and extending at its axis toward the moving direction of the head 16 is arranged between the cap 14 and the head 16. In this embodiment, the elastic material forming the cylinder 26 may generally include, for example, chloroprene rubber, neoprene rubber, styrene-butyl rubber, etc., the rubber hardness of which may preferably be approximately 60° (such as 60°±5°). However, the cylinder 26 is not limited to the abovedescribed rubber and may be formed of other elastic material providing it has the necessary elasticity. The cylinder 26 is so mounted that its upper end portion is engaged with the outer periphery of the lower end of the head 16 and its lower end portion is engaged with the inner periphery of the cap 14, and is deformed axially in a uniform manner to sufficiently pressurize the liquid in a chamber 28 by depressing and lowering the head 16. In other words, the cylinder 26 functions as a piston. Accordingly, in this embodiment, a piston can be eliminated. It is noted that, since the cylinder 26 is axially and uniformly deformed, it is hardly damaged as compared with the conventional dispenser in which the cylinder is partially deformed. A sealing piece 30 extends from the upper end portion of the cylinder 26 into the vertical passage 20 of the head 16 and closely contacts the inner wall of the vertical passage 20, thereby constructing a secondary valve. This sealing piece 30 is radially deformed inwards and is thus isolated from the inner wall of the vertical passage 20 when the pressure of the compressed liquid exceeds the elasticity of the sealing piece 30, allowing the compressed liquid to be passed through the secondary valve, and returns to its original shape due to its own elasticity and is thus closely contacted with the inner wall of the vertical passage 20 when the pressure of the compressed liquid becomes lower than the elasticity of the sealing piece 30, preventing the passage of the compressed liquid through the secondary valve. Accordingly, this embodiment can thus eliminate a secondary valve and a secondary valve spring as in the conventional dispenser. In this emodiment, the sealing piece 30 includes two openings 32 (FIG. 2) spaced 180° apart in the peripheral direction in the vicinity of its base, through which openings 32 the compressed liquid in the chamber 28 flows toward the secondary valve. The chamber 28 is defined between the cylinder 26 and the lower end portion of the cap 14. As shown in FIG. 1, a primary valve 34 formed of plastic is disposed at the lower end portion of the cap 14 and is normally urged to a valve seat 35 by the frictional between the valve 34 and the valve seat 35 by its own weight on the inner surface of the cap 14. When the negative pressure is produced in the chamber 28, the primary valve 34 is isolated from the valve seat 35, thus allowing the flow of the liquid in the chamber 28 from the container 12. In this case, the cylinder 26 may also be formed integrally with the primary valve 34. Thus, the cylinder 26 may be molded as two members which are thereafter coupled. In this case, the primary valve can be omitted, thereby advantageously facilitating the assembly of the dispenser. The lower end of the cap 14 extends downwardly to construct a suction tube 36.

Figure 3:
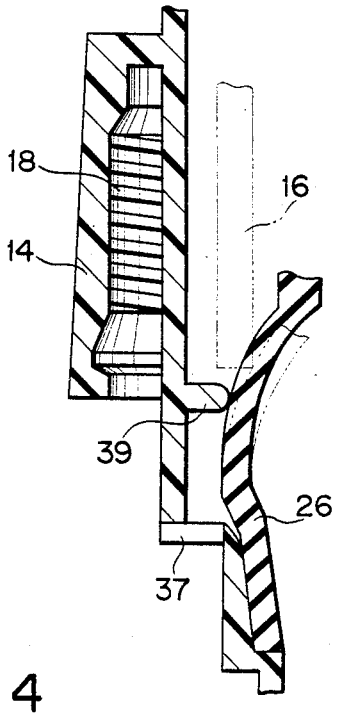
FIG. 3 is a partial fragmentary view showing a modified example of a negative pressure preventing means of a container used in the dispenser in FIG. 1.

In FIG. 1, when the head 16 or the dispenser of this embodiment is depressed, the head 16 moves downwardly against the elasticity of the cylinder 26 in the cap 14, and thus axially deforms the cylinder 26, thereby reducing the volume of the chamber 28. Thus, the liquid in the chamber 28 is pressurized, the sealing piece 30 is deformed and is isolated from the inner wall of the vertical passage 20 of the head 16 when the pressure of the compressed liquid exceeds the elasticity of the sealing piece 30, thereby producing an air gap between the sealing piece 30 and the inner wall of the vertical passage 20. Then, the compressed liquid flows, through the openings 32 and the air gap thus produced into the vertical passage 20 and through the horizontal passage 24 to be dispensed from the outlet port 22. The cylinder 26 is returned to its original shape by its own elasticity when the depression of the head 16 is released. Thus, the volume of the chamber 28 is increased, causing negative pressure or vacuum to be produced in the chamber. Then, the primary valve 34 is raised by means of the negative pressure thus produced, and is isolated from the valve seat 35. Accordingly, the liquid in the container 12 is drawn through the suction tube 36 and the primary valve 34 into the chamber 28, and next cycle is thus prepared completely. When the liquid in the container 12 is thus drawn into the chamber 28, negative pressure or vacuum is produced in the container 12, and impedes the suction of the liquid. In order to prevent the production of such negative pressure or vacuum in the container 12, two negative pressure preventing holes 37 are formed at the intermediate portion of the cap 14, 180° apart from each other in the peripheral direction, and an annular sealing piece 38 is formed at the outer lower periphery of the head 16. Thus, when the head 16 is depressed until the sealing piece 38 contacts and slides on the holes 37, the sealing piece 38 is released from sealing, atmospheric air is thus introduced through the hole 37 into the container 12, thereby preventing the negative pressure in the container 12. This prevention of negative pressure in the container 12 may also be performed by utilizing the elasticity of the cylinder 26. For example, as shown in FIG. 3, an inner flange 39 for securing the sealing in contact with the outer periphery of the cylinder 26 is formed in the cap 14. Then, when the sealing between the inner flange 39 and the outer periphery of the cylinder 26 is released by deforming the elastic cylinder 26 by contacting the part of the head such as the lower end with the cylinder 26 as designated by one-dot chain lines when the head 16 is depressed, the atmospheric air can be readily introduced into the container 12 through the hole 37.

Figure 4:
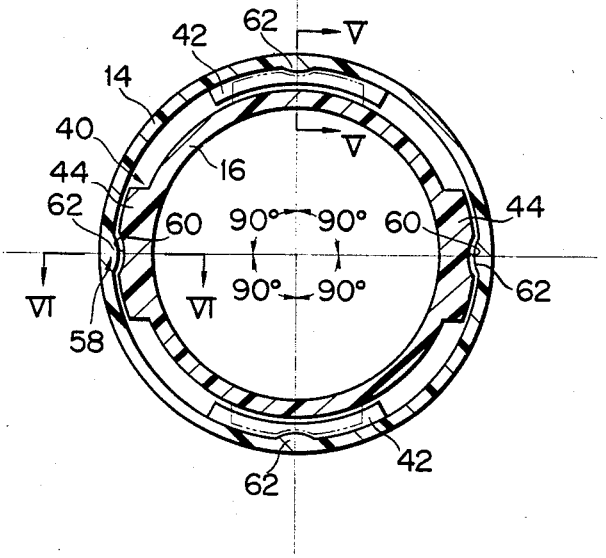
FIG. 4 is a transverse sectional view of the dispenser taken along the line IV—IV in FIG. 1.
Figure 5:
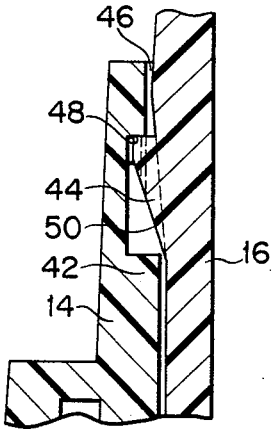
FIG. 5 is a partially longitudinal sectional view of the dispenser taken along the line V—V in FIG. 4 in the case that the externally extending piece is disposed at the position designated by one-dot chain lines.
Figure 6:
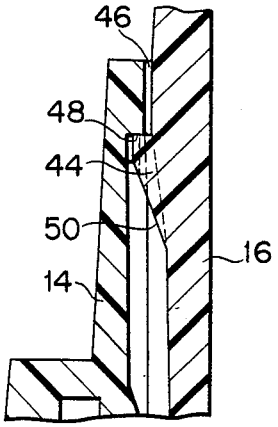
FIG. 6 is a partially longitudinal sectional view of the dispenser taken along the line VI—VI in FIG. 4.

Means 40 for preventing the unnecessary or careless depression of the head 16 at the start of using the dispenser is further provided between the head 16 and the cap 14. This depression preventing means 40 comprises, as shown in FIGS. 4 and 5, an internal extension piece 42 (FIG. 5) extending radially inward from the cap 14 and an external extension piece 44 extending radially outward from the head 16. The external extension piece 44 aligns upwardly with respect to the internal extension piece 42 by rotating the head 16, and contacts the inner extension piece 42 when the head 16 is depressed, thereby preventing the head 16 from moving down. In the embodiment described and shown above, two internal and external extension pieces 42 and 44 are respectively formed apart and spaced at 180° in the circumferential direction. In the state shown in FIG. 4, the extension pieces 42 and 44 are not aligned, thus allowing the downward movement of the head 16 (FIG. 6). When the head 16 is rotated from this state at substantially 90° in either direction, the external extension pieces 44 are aligned upwardly as designated by one-dot chain lines, and even if the head 16 is depressed, the external extension pieces 44 contact the internal extension pieces 42, thereby preventing the head 16 from moving down (FIG. 5). In this manner, the depression preventing means 40 functions as the virgin lock and makes the dispenser childproof. The external extension pieces 44 of the head 16 are upwardly biased by the elastic force of the cylinder 26, have an outer diameter larger than the upper opening 46 of the cap 14 for preventing the removal of the head 16, and are urged at the upper surface to the shoulder 48 of the cap 14. The external extension pieces 44 have tapered surfaces 50 for readily depressing the extension pieces 44 from the upper opening 46 into the cap 14.

The shape, number and position of the internal and external extension pieces 42, 44, a notch 53 (FIG. 7) and external extension piece 54 (FIG. 7) may be variously modified within the spirit and scope of the present invention for attaining the objects of the present invention.

Figure 7:
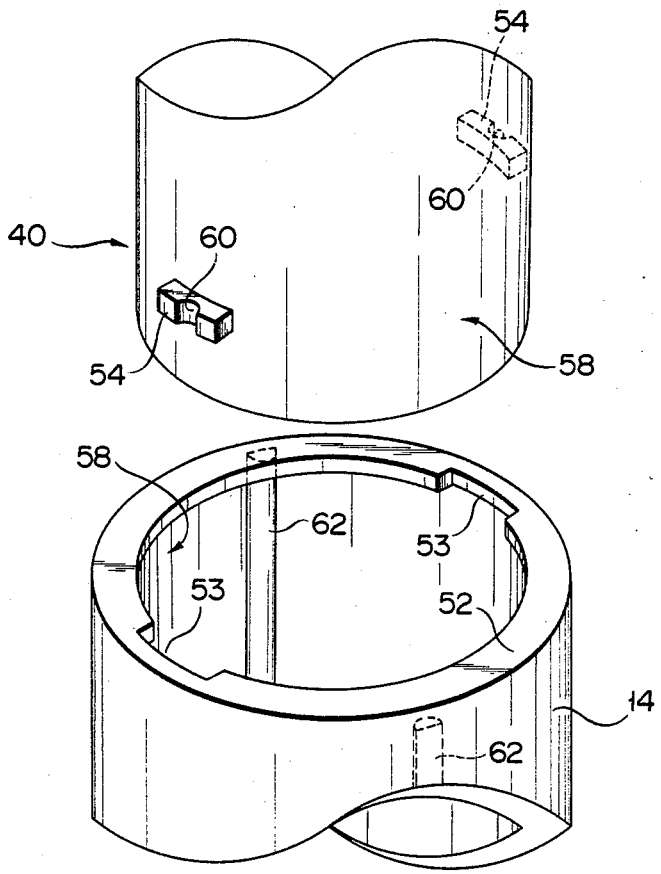
FIG. 7 is a perspective view showing a modified example of depression preventing means used in the dispenser of the present invention.

A modified example of the depression preventing means 40 is shown in FIG. 7. In this depression preventing means 40, the cap 14 includes an inner flange 52, at which two notches 53 are formed apart at 180° in the peripheral direction. On the other hand, two external extension pieces 54 formed to be able to pass through the notches 53 are formed on the head 16. The head 16 is so inserted at its lower end portion into the cap 14 that the external extension pieces 54 are disposed on the inner flange 52, and means for preventing removal is formed at the lower end of the head 16. Thus, the head 16 may be allowed to be downwardly moved only when the head 16 is turned and the external extension pieces 54 are aligned with the notches 53.

It is preferred to secure the positions of the head 16 capable of being depressed and impossible to be depressed by restricting the rotation of the rotatable head 16 with respect to the cap 14. For that purpose, means 58 for limiting the rotation of the head 16 is provided in the dispenser 10. As seen from FIGS. 4 and 7, this rotation limiting means 58 includes engaging grooves 60 formed on the outer peripheral surface of the head 16 and corresponding engaging projections 62 to be engaged with the engaging grooves for limiting the rotation of the head 16. In the embodiment described above, four engaging projections 62 are formed at 90° from each other in the circumferential direction extending in the axial direction, and two of them are disposed at the upper center of the internal extension pieces 42. On the other hand, the engaging grooves 60 are formed at the center of the external extension pieces 44. When the engaging grooves 60 are thus engaged with the engaging projections 62 not formed at the upper center of the internal extension pieces 42 in this structure, the head 16 may be depressed downwardly without being disturbed by the internal extension pieces 42. At this time since the engaging grooves 60 are engaged with the engaging projections 62 extending axially to be guided along the axial direction, the head 16 is not rotated while it is moving downward, thereby securing the downward movement of the head 16. When rotary torque is, however, applied to the head 16 to turn the head 16 at 90° and the engaging grooves 60 are engaged with the engaging projections 62 at the upper center of the internal extension pieces 42, the external extension pieces 44 are contacted, even if the head 16 is depressed, with the internal extension pieces 42, and the head 16 is not accordingly moved downward. Since the engaging grooves 60 are engaged with the engaging projections 62, even in this case to prevent the head 16 from rotating, the head 16 may not rotate unless considerably larger torque is applied. In this manner, a locking state of the head 16, inhibiting the downward movement of the head 16 can be effectively obtained, thereby sufficiently preventing the unnecessary or careless downward movement of the head 16.

According to the head depression type dispenser of the present invention, a known vortex means such as a spinner may be disposed adjacent to the outlet port formed at the head 16, and the dispenser thus constructed can be applied as a sprayer, and a known foaming means may be similarly disposed, and the dispenser thus constructed can also be applied as a foamer. In this specification, the dispenser includes a sprayer and a foamer.

According to the head depression type dispenser embodying the present invention, the cylinder formed of an elastic material and axially extending at its axis of the head is disposed between the head and the cap. Then, the second valve is formed in contact with the inner wall of the passage in which the sealing piece extends from the cylinder into the passage of the head. In this structure, the cylinder is deformed by depressing the head to pressurize or suck the liquid in the container. In other words, the cylinder acts also as a piston, thereby eliminating the piston. Thus, the cylinder is returned to its original shape by its own elasticity, thereby also eliminating the return spring. Further, the sealing piece is formed as a part of the cylinder to form the secondary valve. In other words, the cylinder also acts as the secondary valve, thereby eliminating the secondary valve. Since the secondary valve is closely contacted with the valve seat by the elasticity of the sealing piece, the secondary valve spring can also be eliminated. In this manner, the cylinder is constructed advantageously according to the present invention, thereby eliminating the piston, return spring, secondary valve and secondary valve spring, and also reducing the number of components of the dispenser of this type of almost one half that of the conventional dispenser. Thus, the head depression type dispenser according to the present invention can be inexpensively manufactured.

What is claimed is:

1. A dispenser adapted to be attached to an opening of a container for dispensing a liquid received in the container, comprising:

a cap removably attachable to said opening of said container and having a through hole extending in an axial direction thereof, said through hole communicating with said opening of said container;

a head which is fitted into one end of said through hole and which is movable in and around the axial direction of said cap, said head having one end which is located outside of said cap and another end which is located inside of said cap, and said head having a passage which has one end open outside of said cap and another end in said through hole, said head having an outer surface;

an elastically deformable cylinder which is formed of an elastic material, said cylinder defining an inner space in the form of a chamber, said cylinder being received in said through hole, and said cylinder having one end which is connected to said another end of said passage;

a suction pipe having one end connected to the other end of said cylinder and another end which is positioned in said container;

a primary valve attached to said one end of said suction pipe, and allowing communication between said chamber defined by said cylinder and said container, whereby liquid in said container is sucked up into said chamber when the pressure in said chamber is negative; and a secondary valve attached to said another end of said head, and allowing communication between said chamber and the outside whereby the liquid in said chamber is dispensed to the outside through said passage when the pressure in said chamber is increased by pressing said head to contract said chamber;

said cap including an inner flange having at least one notch;

said head including at least one external extension piece extending from the outer surface of said head and which is capable of passing through said at least one notch of said inner flange, for allowing relative movement between said cap and said head and preventing said head from moving into said cap unless said at least one external extension piece of said head is aligned with said at least one notch of said inner flange of said cap;

said head further including at least one engaging groove formed on the outer peripheral surface of said at least one external extension piece;

said cap further including at least one engaging projection extending internally of said cap and which, when in engagement with said at least one engaging groove of said head, prevents relative rotation between said head and said cap about the axis of said through hole; and said at least one engaging groove and said at least one engaging projection being arranged such that they are engagable with one another when said at least one external extension piece of said head is aligned with said at least one notch of said inner flange of said cap or is not aligned with said at least one notch of said inner flange of said cap.

* * * * *